US005577612A

United States Patent [19]

Chesson et al.

[11] Patent Number: 5,577,612

[45] Date of Patent: Nov. 26, 1996

[54] FABRIC SOFTENER SHEET DISPENSER CARTONS

[75] Inventors: Sharon Chesson, Bradenton, Fla.; James Stone, Grand Rapids, Mich.

[73] Assignee: Lever Brothers Company, Division of Conopco Inc., New York, N.Y.

[21] Appl. No.: 263,306

[22] Filed: Jun. 21, 1994

[51] Int. Cl.[6] ..... B65D 85/62

[52] U.S. Cl. ..... 206/494; 221/63; 229/232

[58] Field of Search ..... 229/232, 149, 229/207; 206/494; 221/63

[56] References Cited

U.S. PATENT DOCUMENTS

| | | | |
|---|---|---|---|
| D. 214,879 | 8/1969 | Roccaforte et al. . | |
| D. 311,493 | 10/1990 | Boone . | |
| 1,988,582 | 1/1935 | Weiss . | |
| 2,009,464 | 7/1935 | Winter . | |
| 2,529,853 | 11/1950 | Taggart . | |
| 2,973,086 | 2/1961 | Thompson | 229/232 X |
| 2,991,000 | 7/1961 | Spees . | |
| 3,021,002 | 2/1962 | Guyer | 206/494 |
| 3,059,827 | 10/1962 | Pellaton et al. . | |
| 3,071,304 | 1/1963 | Brastad . | |
| 3,167,238 | 1/1965 | Smith . | |
| 3,357,631 | 12/1967 | Aid et al. | 229/232 |
| 3,366,310 | 1/1968 | Simpson et al. . | |
| 3,580,482 | 5/1971 | Witte . | |
| 3,895,128 | 7/1975 | Gaiser . | |
| 3,918,608 | 11/1975 | Faller . | |
| 3,986,479 | 10/1976 | Bonk . | |
| 4,043,503 | 8/1977 | Meyers et al. . | |
| 4,044,919 | 8/1977 | Olson . | |
| 4,413,769 | 11/1983 | Michetti . | |
| 4,458,810 | 7/1984 | Mahoney . | |
| 4,512,476 | 4/1985 | Herrington, Jr. . | |
| 4,577,762 | 3/1986 | Kuchenbecker . | |
| 4,674,635 | 6/1987 | Huldin et al. . | |
| 4,687,104 | 8/1987 | Ielmini . | |
| 4,714,643 | 12/1987 | Kuenzel . | |
| 4,738,365 | 4/1988 | Prater . | |
| 4,746,019 | 5/1988 | Prater . | |
| 4,765,508 | 8/1988 | Poppe . | |
| 4,790,436 | 12/1988 | Nakamura . | |
| 4,836,438 | 6/1989 | Rigby . | |
| 4,886,170 | 12/1989 | Willey et al. . | |
| 4,919,785 | 4/1990 | Willey et al. . | |
| 5,054,612 | 10/1991 | Meyer, Jr. . | |
| 5,078,273 | 1/1992 | Kuchenbecker . | |
| 5,085,323 | 2/1992 | Kuchenbecker et al. . | |
| 5,123,589 | 6/1992 | Cote . | |
| 5,305,881 | 4/1994 | Caldwell et al. . | |
| 5,310,057 | 5/1994 | Caldwell et al. . | |

FOREIGN PATENT DOCUMENTS

| | | | |
|---|---|---|---|
| 35163 | 9/1981 | European Pat. Off. . | |
| 2285789 | 9/1974 | France . | |
| 1009558 | 5/1957 | Germany | 229/232 |
| 3021937 | 12/1980 | Germany . | |
| 568891 | 11/1975 | Switzerland . | |
| 1348500 | 3/1974 | United Kingdom . | |
| 1552344 | 9/1979 | United Kingdom . | |

OTHER PUBLICATIONS

Photographs (1–4) of Procter and Gamble Ultra Bounce Carton.

*Primary Examiner*—Bryon P. Gehman
*Attorney, Agent, or Firm*—Gerald J. McGowan, Jr.

[57] ABSTRACT

A carton for housing sheets, particularly dryer sheets. The dryer sheets are preferably stacked in a "U" shape and are removed via an access flap which may include 2 hinges and may be recloseable. The carton of the invention includes lines of weakness defining the recloseable access flap in top and front panels. Portions of the front panel lateral to the access flap are attached to an underlying panel or flap, so that when the access flap is separated from the front panel to open the carton, the lateral portions remain attached to the underlying flap or panel.

29 Claims, 7 Drawing Sheets

FABRIC SOFTENER SHEET DISPENSER CARTONS

BACKGROUND OF THE INVENTION

One method of applying fabric softener to clothes utilizes sheets impregnated with fabric softening materials. These sheets may be readily placed in the dryer with the clothes. During drying the fabric softening actives and optionally other materials, such as perfumes, are transferred to the clothes.

Previously, fabric softener sheets have generally been provided to consumers in the form of a roll. Individual sheets are formed by separating the sheets from the roll at lines of weakness provided at intervals along the roll. Perforations do not always perform reliably to give a clean separation with exertion of minimal force, particularly where the sheet is sufficiently durable to survive the temperatures and tumbling action of a clothes dryer.

Additional problems associated with the use of dryer sheets include the escape of fragrance from the carton prior to use.

Sheets of various shapes are known for use in household products. Individually folded dove tail sheets are known for products such as dusting cloths.

Various cartons having reclosure tabs are disclosed in the art. These include Prater U.S. Pat. Nos. 4,738,365 and 4,746,019, Ielmini U.S. Pat. No. 4,687,104, and Cote U.S. Pat. No. 5,123,589.

Willey et al. U.S. Pat. No. 4,886,170 discloses a microwave carton having front flap portions 76 sealed to the side panel outside of center portion 94 wherein an access panel is removed.

Willey et al. U.S. Pat. No. 4,919,785 is similar to the above Willey et al. patent, except that in FIG. 4, the access aperture is disclosed transversely of the blank.

Kuchenbecker et al. U.S. Pat. No. 5,078,273 discloses a microwave carton and blank therefor. Portions of an overlying front panel 14 remain after the lift tab has been removed on either side of the space created by the removal of the tab.

Cote U.S. Pat. No. 5,123,589 discloses a rigid film pack including a reclosure tab, a reclosure slit and two lateral seal tabs.

Dispensing cartons having access apertures and containing individual non-interleaved, U-shape bundled fabric softener sheets are disclosed in Caldwell et al. U.S. Pat. Nos. 5,310,057 and 5,305,881. However, due particularly to the escape of perfume into the air which occurs when the cartons are open, a package which is perceived as being readily reclosable is preferred.

SUMMARY OF THE INVENTION

The present invention concerns a dispenser which is advantageously used for the dispensing of dryer sheets which are stacked and dispensed as individual sheets rather than torn from a roll. The carton of the invention includes lines of weakness defining a reclosable access flap in the top and front panels. One of the front or top panels includes a first score line defining a hinge by which the access flap is permanently attached to the top or front panel. A scoreline which separates the front and top panels traverses the access flap so that the portion of the panel-separating score line traversing the access flap is positioned to act as a second hinge for opening and reclosure of said access flap. Portions of the front panel lateral to the access flap are attached to an underlying panel or flap, so that when the access flap is separated from the front panel to open the carton, the lateral portions remain attached to the underlying flap or panel. Preferably the access flap includes a reclosure tab and the underlying flap or panel has an aperture dimensioned to receive said reclosure tab.

Preferably, the sheets are dispensed from a stack wherein a substantial number of sheets are offset from the majority of the sheets along the surface of the sheets facing the opening of the carton so that the stack has an effective distance along the surface facing the opening which is generally greater than the distance along the surface for any of the sheets. This permits the opening in the carton to be wider relative to the surface of the individual sheets facing it than would otherwise be possible, consistent with effective containment of the sheets by the carton when the carton is open. This is advantageous in that a wider opening relative to the size of the individual sheets facilitates removal of the sheets. Typically, the end-to-end distance of the surface facing the opening is the width of the sheet and of the stack.

Use of the sheets is facilitated by providing each individual sheet with a dove tail fold which can be readily grasped.

Preferably, the sheets are stacked within the carton in a generally "U" shape folded along their transverse axes and the width of the carton aperture at the bight of the fully loaded stack of sheets is advantageously such that the ratio of the width of the carton opening at that point to the width of the stack of sheets along the surface of the stack facing the opening is within the range of about 0.55 to about 0.76, preferably about 0.7 to about 0.75.

The dispensing carton of the invention preferably does not utilize a fiberboard or other core material around which the rolls of fabric softener sheets are wrapped. In the past, when the roll was empty such cores were discarded, resulting in additional waste to be contributed to the environment. The present invention does not require a core or other supporting insert and permits use of less shelf space. Also, when the carton and sheets of the invention are employed, there is no need for the consumer to struggle to tear a sheet cleanly from the remaining sheets on the roll.

The invention also concerns a blank for forming the dispenser, as well as the dispenser containing the sheets.

For a more complete understanding of the above and other features and advantages of the invention, reference should be made to the following detailed description of preferred embodiments and to the accompanying drawings.

DETAILED DESCRIPTION OF THE INVENTION

The sheets 10 are fabricated from a durable, woven or non-woven material which will be normally be a fibrous polymeric material such as polyester or rayon. If desired, the material may have a melting point such that it will not melt at temperatures prevalent in clothes dryers. Typically, the melting point of the sheet will be above about 220° C. The sheet is impregnated with materials suitable for transfer to the clothes during drying to provide a softening effect. Materials suitable for use in fabric softening sheets are described in Rudy et al. U.S. Pat. Nos. 4,421,792; 4,327,133; 4,238,531; 4,012,326 and 3,972,131, the disclosures of which are incorporated herein by reference, among others.

Figure 1:
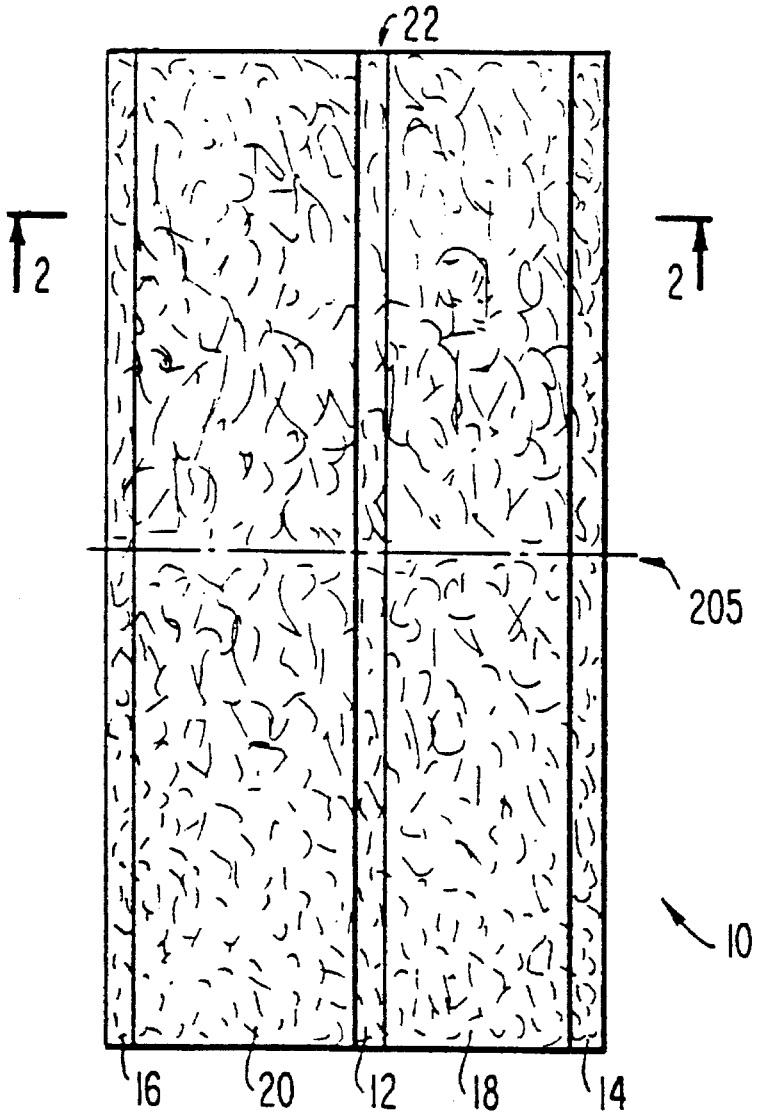
FIG. 1 is a top plan view of a dryer sheet of the invention.
Figure 2:
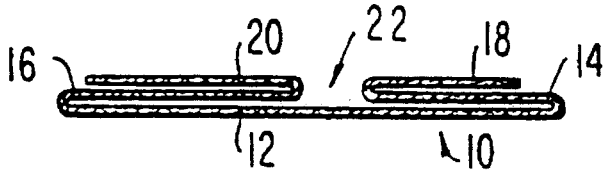
FIG. 2 is a cross-section along the lines 2—2 of FIG. 1.

The sheet is provided with a dove tail fold, as can best be seen in FIGS. 1 and 2. The essence of the dove tail fold is that the sheet includes a flat bottom layer, intermediate layers formed by medial folds on each of the sides of the flat bottom layer and at least one and preferably two top layers folded laterally away from the center of the sheet. Ideally, an appreciable space or gap is left between the medial edges of the top layer.

The dove tail folds of the sheet 10 can be seen particularly in FIG. 2 wherein the flat bottom layer is denoted by reference number 12 and is folded medially to form two intermediate layers 14 and 16 which in turn are folded laterally to form two top layers 18 and 20. An appreciable gap 22 is left between the medial edges of the folds which form the top layers 18 and 20.

The folds are effected using equipment such as an SRI machine available from Accratec of Neenah, Wis.

The carton is preferably made from paperboard. The paperboard may be coated, e.g., by a ½ mil of low density polyethylene extruded onto the inside surface. The coating provides a barrier to any perfume and nonionic surfactant and helps strengthen the reclosure slot. The paperboard may include on the inside or outside a printed barrier obtained by fluorochemical treatment to provide wet strength for the flap including the reclosure slot. The paperboard may, for example, range from 16 or 18 to 22 or 24 mils in thickness, preferably 20 point.

Figure 3:
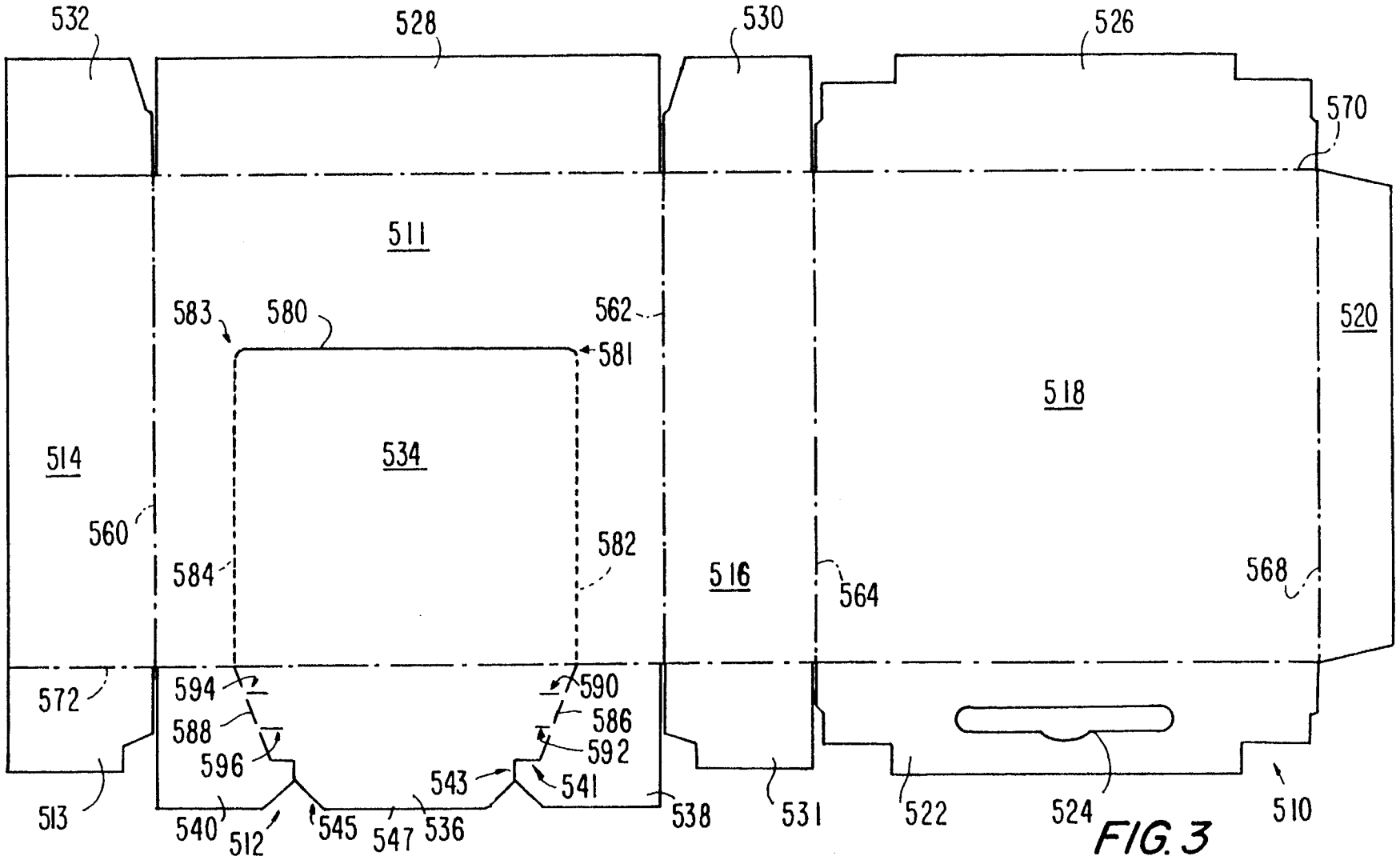
FIG. 3 is a top plan view of a carton blank according to one embodiment of the invention.

Referring to FIG. 3, carton blank 510 comprises top panel 511, bottom panel 518, and two side panels 514 and 516. A glue flap 520 is separated from bottom panel 518 by score line 568. Panels 514, 511, 516 and 518 are separated respectively by transverse scorelines 560, 562 and 564. Longitudinal scoreline 570 separates side panel 514 from minor flap 532, top panel 511 from major flap 528, side panel 516 from minor flap 530 and bottom panel 518 from major flap 526.

Longitudinal scoreline 572 separates side panel 514 from minor flap 513, top panel 511 from front panel 512, side panel 516 from minor flap 531 and bottom panel 518 from major flap 522. Flap 522 has an aperture 524 cut therein to accommodate tab 536 of access flap 534. The preferred aperture is narrow and elongated, i.e., a slot, as illustrated. Access flap 534 spans top panel 511 and front panel 512. The access flap is defined by a score line 580 in the top panel, which forms a hinge, lines of weakness 582 and 584 extending from the hinge to scoreline 572, further lines of weakness 586, 588 extending inwardly from scoreline 572 and the distal edge at tab 536.

Lines of weakness 582 and 584 are preferably staggered perforated cut lines and extend perpendicularly to both score line 580 and score line 572. Lines of weakness 582 and 584 are preferably connected to score line 580 by radius 581 and radius 583, respectively, which comprise short curved cuts in the top panel. Connection of the lines of weakness to the hinge line by short radial cuts rather than non-perpendicular, oblique straight lines (e.g., rather than diagonal perforated cut lines) facilitates opening of the carton. Use of perforated lines extending diagonally from lines 582, 584 to the hinge line, even though connected to lines 582, 584 by a radius, has been found to result in a tendency to continue tearing along the axis of the perpendicular lines past the line of weakness toward the rear of the front panel, thus creating a messy tear.

Lines of weakness 586 and 588 are preferably cut lines having with small portions uncut as seen at 590, 592, 594 and 596 (J cuts).

It will be noted that the portion of access flap 534 situated in front panel 512 includes the lines of weakness 586 and 588 (J cuts) extending diagonally inwardly from score line 572, a cut line 541 extending inwardly in a direction parallel to score 572, then a cut line 543 extending perpendicularly to score 572 and then free edge 545 extends diagonally inwardly to edge 547 which extends parallel to score 572. Cut line 543 will have a small uncut portion toward its middle, which will be torn when the access flap is opened.

The shape of tab 536 facilitates its use in reclosure of the carton. In particular, the arrow shape of the tab, including parallel (to score 572) portion 541, perpendicular portion 543 and then diagonal portion 545 to the tab edge 547, are believed to facilitate snug reclosure of the carton.

Figure 4:
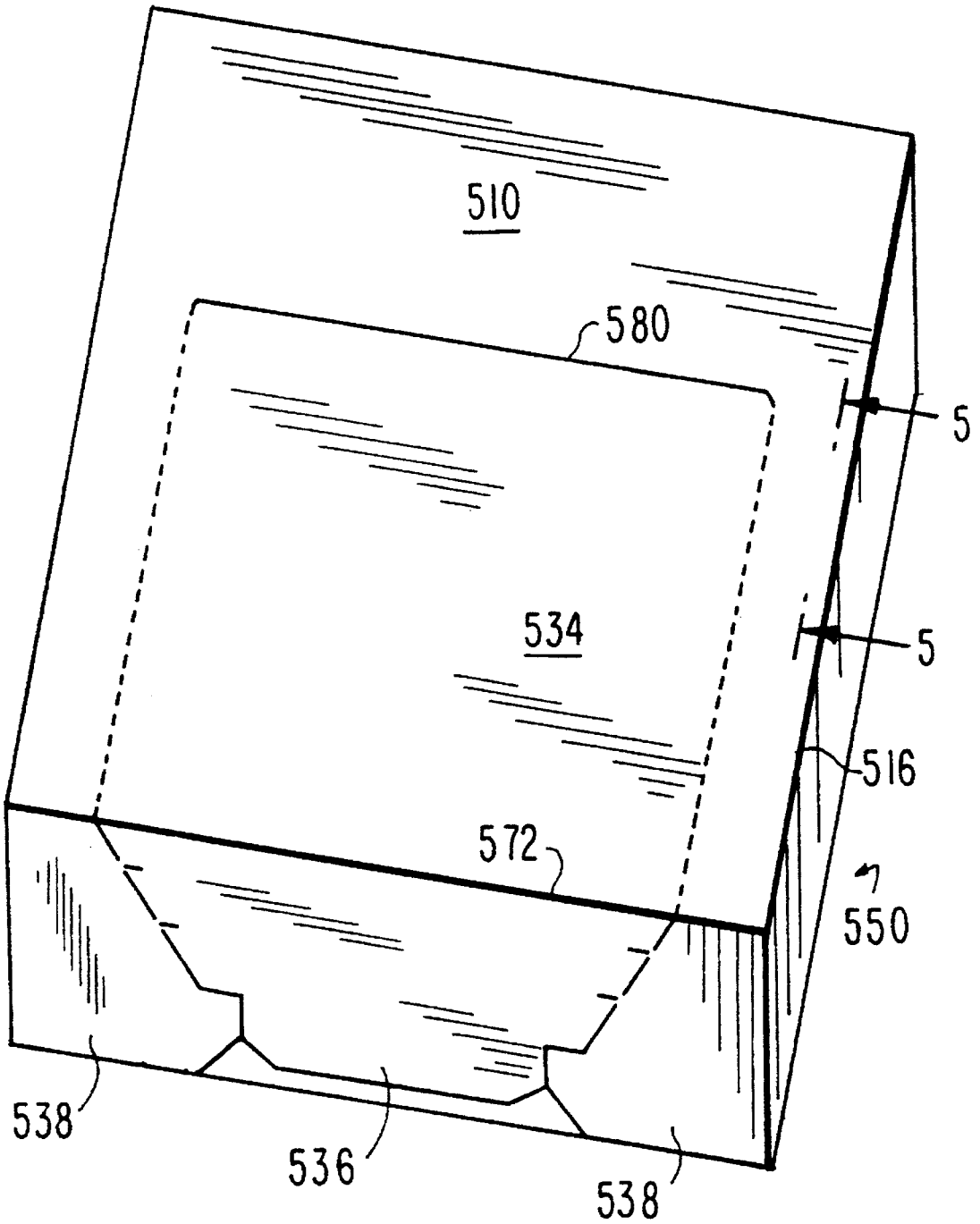
FIG. 4 is a perspective view of the combined carton and sheets of the invention made from the blank of FIG. 3.

The erected carton formed from the blank of FIG. 3 is shown in FIG. 4. The carton is formed by adhering glue flap 520 to side panel 514. Then the carton is squared and minor flaps 530 and 532 are folded inwardly and inside major flap 526 and outside major flap 528 are folded and adhered to each other. Then, minor flaps 513 and 531 are folded inwardly, and inside major panel 522 is folded. Hot melt or other adhesive is applied to the two lateral aspects of panel 522 which will be covered by portions 538 and 540 of the front panel so that when front panel 512 is folded and adhered to panel 522 only portions 538 and 540 and not the access flap 534, e.g., not tab 536, will adhere. The access flap (including the reclosure tab) is preferably not attached to the underlying flap or panel.

Figure 8:
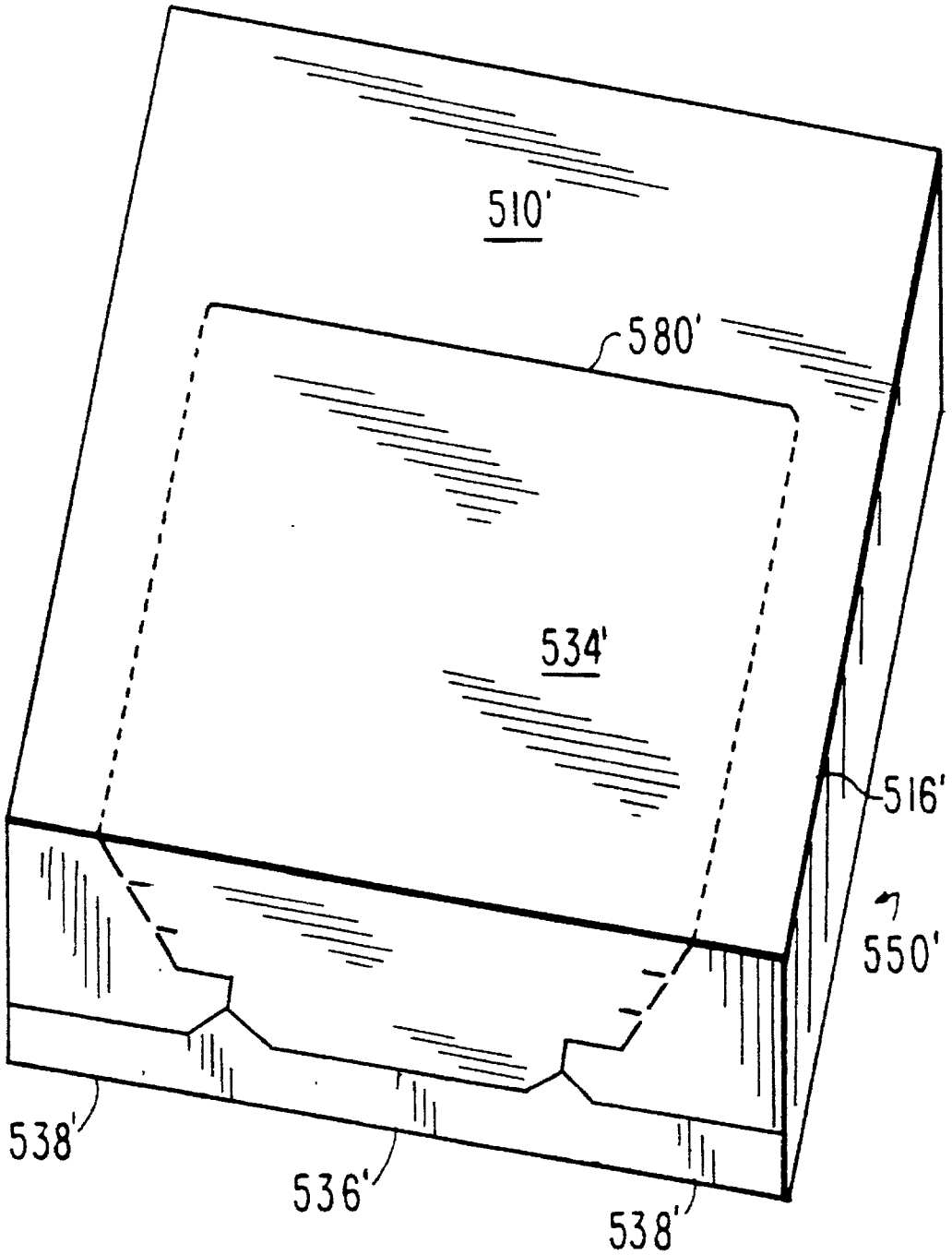
FIG. 8 is a perspective view similar to FIG. 4 illustrating a further embodiment of the invention.

As can be seen in FIG. 8, wherein reference numerals corresponding to those of FIG. 4 are primed, the front panel desirably extends no more than 75% or 80% of the distance from the scoreline separating the top panel from the front panel to the scoreline separating the underlying flap or panel from the bottom panel.

Figure 5:
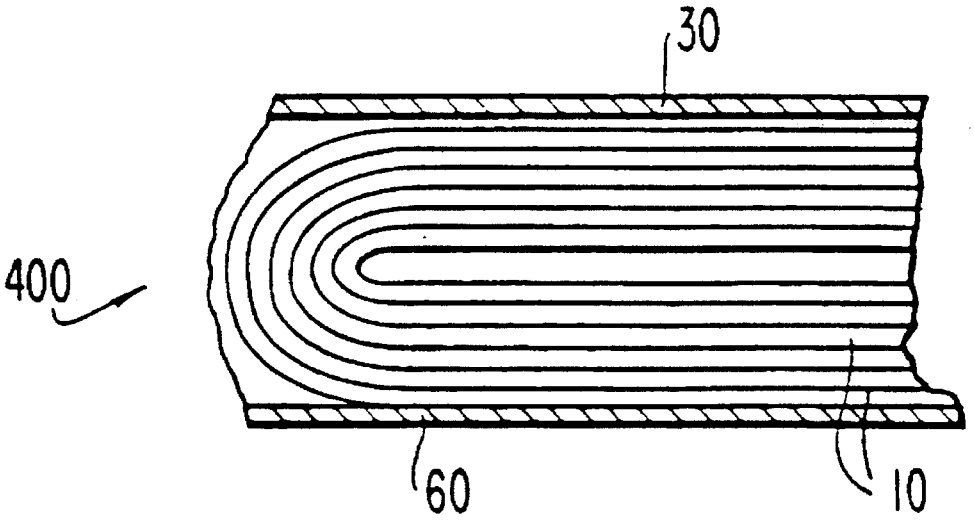
FIG. 5 is a cross-section along the lines 5—5 of FIG. 4.
Figure 6:
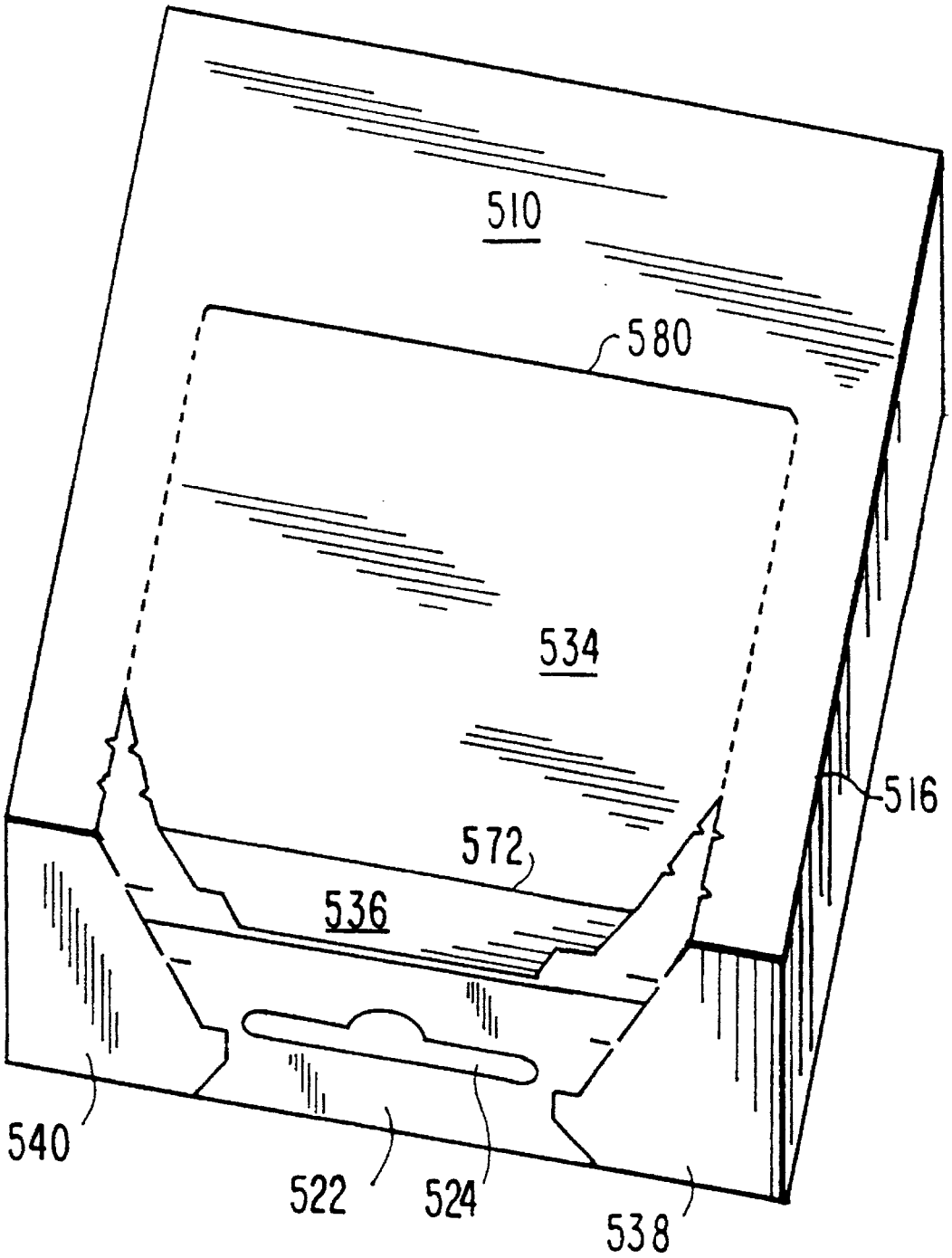
FIG. 6 is a perspective view of the carton of FIG. 4 wherein the access flap is partially open.

In operation, the consumer lifts tab 536 to open the access flap 534. In a carton filled with fabric softener sheets, a cross section of the carton of FIG. 4 will appear as shown in FIG. 5. A partially opened carton is shown (without the sheets) in FIG. 6. Separation of the access portion of front panel 512 from portions 538 and 540 reveals underlying inside major flap 522 having aperture 524. Since fabric softener sheets typically are perfumed, opening of the access flap will release perfume into the air. After one or more sheets have been removed for use, the access flap may be reclosed by inserting tab 536 into aperture 524, thus snugly closing the carton and minimizing any further release of perfume.

Preferably, the sheets are not interleaved but lie adjacent to each other without any interlocking of the folded layers between adjacent sheets. The sheets are preferably not disposed within the folds of any adjacent sheets. The absence of interleaving is to result in less loss of perfume and exposure of the sheets to the air since interleaving would cause partial removal of the subsequent sheet after removal of the previous one.

No insert is required within the carton to support the stack. The stack preferably folds only in the "U"-shape; the arms of the U do not themselves fold again along a transverse axis of the sheets. The sheets do not require any starting strips to remove the first or subsequent sheets from the carton. The first sheet is identical to subsequent sheets.

When the consumer wishes to use one of the sheets, he/she simply grasps the sheet through the opening formed by lifting up the access flap. Grasping of the sheet is facilitated by the presence of gap 22. The long axis of the aperture along score line 40 facilitates removal of the sheet whereas the minimized vertical dimension of the aperture from top to bottom as reflected in the decreased length of cuts 42 and 44 relative to the longitudinal axis through the score line and the angle of the cuts are to minimize the escape of perfume through the aperture. The "U" fold of the sheets also facilitates removal.

Preferably, when the dryer sheets are fully loaded within the carton in the "U" orientation wherein the bight or inflection point 400 faces the access opening, the ratio of the access opening to the width of the stack of dryer sheets or the width of the stack of sheets is within a defined range. In particular, it is preferred that the ratio is within the range of about 0.55 to about 0.76, especially about 0.7 to about 0.75, and most preferably about 0.73 to about 0.74. Design of the carton in accordance with the above ratios is to facilitate removal of the sheets by the consumer and to minimizing the size of the opening for decreasing escape of perfume and premature exiting of the sheets from the carton.

The ratio of the area of the plane of the folded sheet or the ratio of the area of the plane encompassing the overall width of the stack of folded sheets to the area of the access opening is preferably within the range of 1:2.5 to 1:5.0.

For a 20 sheet carton, the height of the carton would typically be 1⅜ inches, the length 4⅝ inches and the width 4½ inches. For a 20 sheet carton, the height could be expected to be within the range of from 1 to 1½ inches. For a 40 sheet carton, the height would typically be 2¼ inches, and the length and width the same as for the 20 sheet carton. The height could vary from 2 to 2½ inches. For the 60 sheet carton, the height could be 3 inches, ranging from 2⅔ inches to 3¼ inches. The length and width would be as for the other cartons.

During closure of the carton, score line 580 functions as a hinge by permitting the access flap to pivot and thereby open and close. Score line 572 serves as a second hinge to permit the access flap portion therebelow to pivot so that tab 536 can be inserted within aperture 524.

The use of a reclosable flap is to minimize unwanted escape of perfume into the air when the sheets are not being used and helps protect the sheet from moisture and other elements in the air.

Figure 7A:
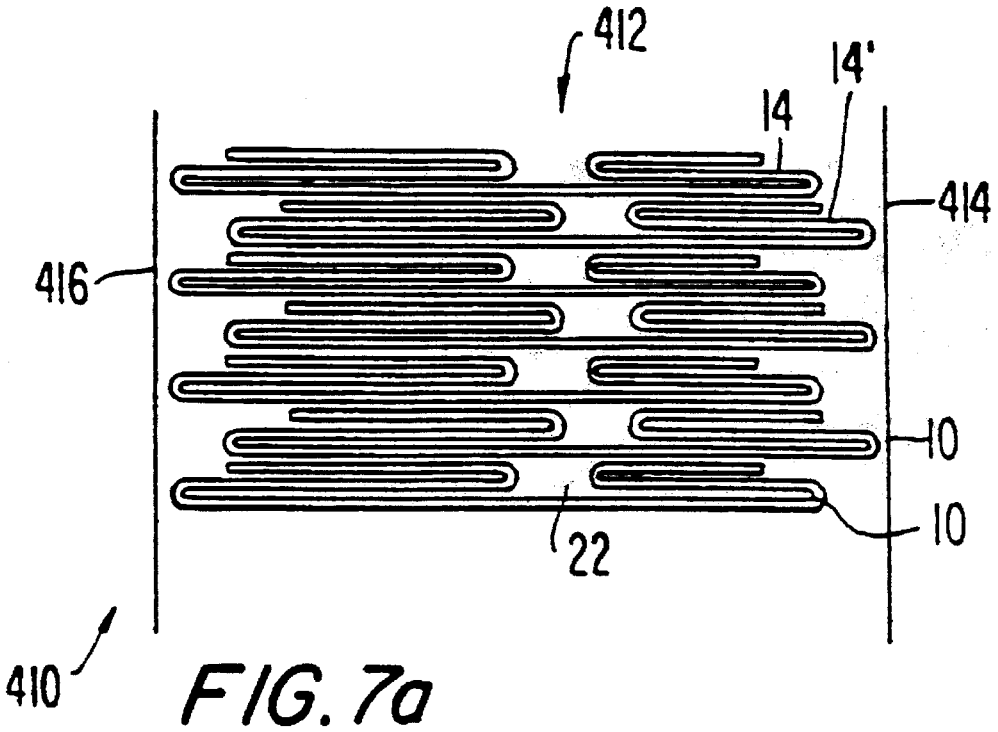
FIG. 7*a* is a front view of a stack of dryer sheets according to the invention.

The sheets within a stack may be offset. By offset it is meant that the sheets do not lie directly on top of each other. As seen in FIG. 7*a*, the stack 410 comprises sheets 10 which lie on top of each other in an arrangement wherein each sheet is offset in a transverse direction from that above. As a result, alternating sheets are disposed with their edges in the same plane.

Figure 7B:
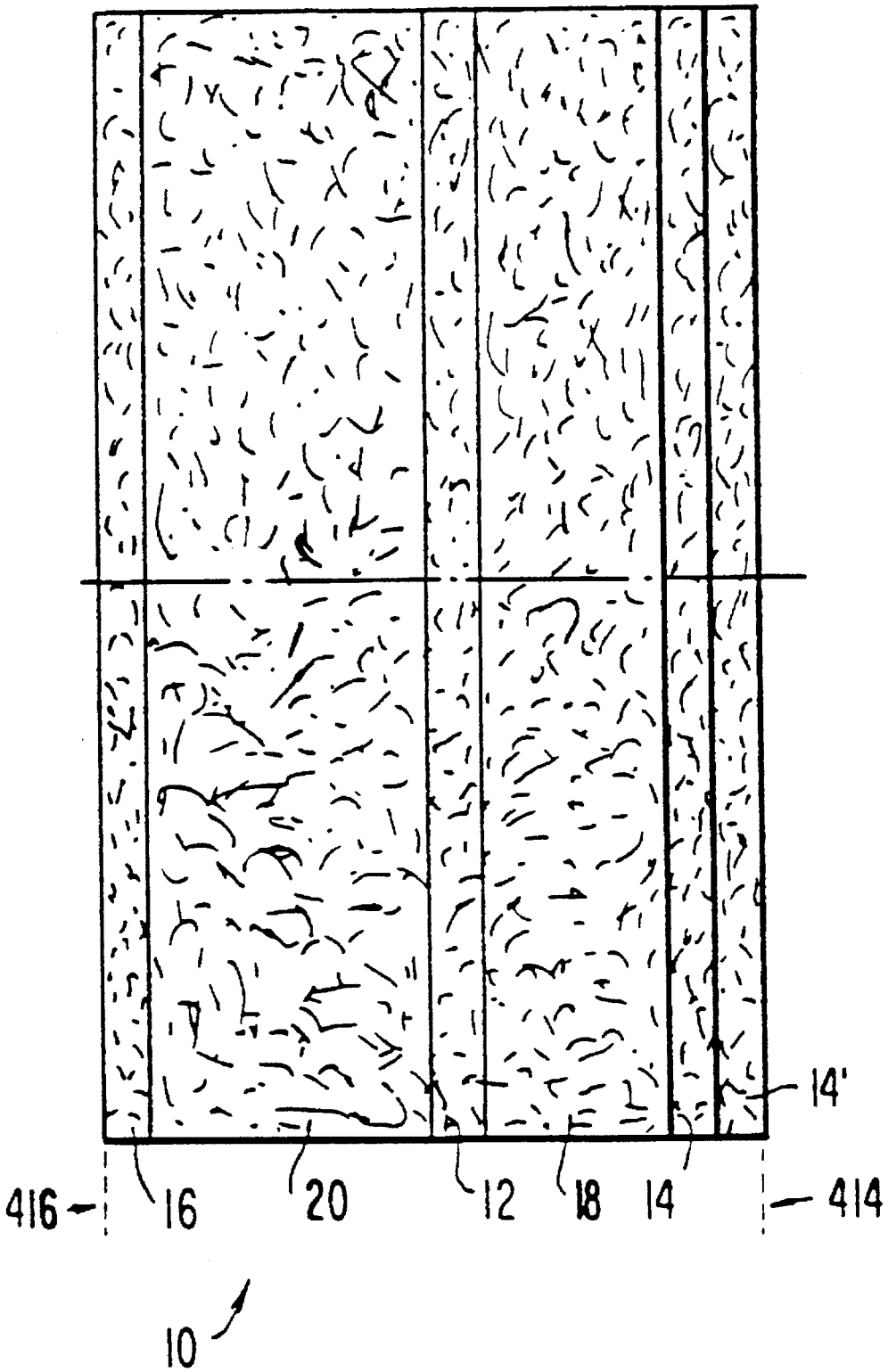
FIG. 7*b* is a top plan view of the stack of FIG. 14*a*.

When viewed from above as in FIG. 7*b*, sheet 10 can be seen as well as a portion of intermediate layer 14' of the underlying sheet. Preferably, the sheets are offset by at least 5% of their width, preferably at least 9% of their width.

The stack is then folded into the "U" shape along the transverse axis for dispensing and inserted into a carton so that the top 412 of the stack faces a dispensing opening in the carton. It is believed that because of the offsets, the opening of the carton sees an effective stack width equal to the distance between the plane 414 passing through the most remote edges of one side of the stack and the plane 416 passing through the remote edges of the sheets on the other end of the stack. As a result, the stack remains secure within the carton even after the opening has been formed. However, the individual sheets see an opening which is wider than would otherwise be possible and are more readily removed.

Although the stack is illustrated as being folded along the transverse axis, this is not imperative. The benefit of this aspect of the invention is obtained so long as the sheets are dispensed from a stack wherein a substantial number of sheets are offset from the sheets, if any, immediately above or below along the surface of the sheets facing the opening of the carton so that the stack has an effective distance along the surface facing the opening which is greater than the comparable end to end distance of any of the sheets. Preferably the distance is measured along the same axis as the axis of the opening, if the opening has an axis which is longer in one direction than in the other, e.g., if the opening is rectangular or oval. It is preferred that at least 20%, especially 40% of the sheets are offset with respect to at least the sheet immediately above or immediately below. It is especially preferred that at least 50% of the sheets are offset with respect to the sheet, if any, immediately above and the sheet, if any, immediately below. Ideally at least 90% of the sheets are offset with respect to the sheet, if any, immediately above and the sheet, if any, immediately below.

Although a U-shaped bundle of sheets may be employed, the sheets may also lie flat, if desired.

While it is preferred that the carton and blank include a reclosure aperture, this may sometimes be omitted. In such cases, instead of tucking the access flap into the aperture, the access flap may be reclosed by inserting it behind the panel or flap which underlies it prior to opening.

In the preferred embodiment, the lines of weakness forming the access flap are perpendicular to the scoreline separating the top and front panels. However, it may be appropriate to place the lines of weakness non-perpendicularly, e.g., obliquely, to the top and front panel-separating scoreline. Likewise, although the cut lines extending inwardly from the diagonal lines of weakness on the front panel have been illustrated in the preferred embodiment as being parallel to the scoreline separating the top and front panels, cut lines or other lines of weakness extending inwardly from the diagonal lines of weakness, which do not extend parallel to the front and top panel-separating scoreline may be employed.

It should be understood, of course, that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A carton comprising a top panel and a front panel, said front and top panels including lines of weakness in part defining a recloseable access flap, one of said front and top panels including a first score line defining a hinge by which said access flap is permanently attached to said one panel, a panel-separating score line separating said front and top panels, at least a portion of said panel separating score line traversing said access flap whereby said portion of the panel-separating score line traversing said access flap is positioned to act as a second hinge for opening and reclosure of said access flap, portions of said front panel lateral to said access flap being attached to an underlying panel or flap, so that when said access flap is separated from said front panel to open the carton, said lateral portions remain attached to said underlying flap or panel, said access flap having a reclosure tab, said underlying flap or panel having an aperture dimensioned to receive said reclosure tab, said carton including a panel adjacent said top panel, on a side opposite said front panel, said adjacent panel having two ends, a flap having two free side edges being disposed at each end of said adjacent panel, said underlying flap having two sides and not including a minor flap adjacent both of said sides.

2. The carton according to claim 1 wherein said underlying flap or panel constitutes an inside major flap.

3. The carton according to claim 1 wherein said lateral portions are present on both sides of said access flap.

4. The carton according to claim 1 further comprising side panels on opposite sides of said top panel and separated therefrom by parallel scorelines perpendicular to the scoreline separating said top panel from said front panel, and a bottom panel separated from one of said side panels by a scoreline parallel to the scoreline separating said side panel from said top panel, said underlying flap or panel being separated from said bottom panel by a scoreline perpendicular to the scoreline separating said bottom panel from said side panel.

5. The carton according to claim 4 wherein said underlying flap or panel is an inside major flap.

6. The carton according to claim 5 wherein each of said side panels includes two ends and said side panels each has a minor flap separated from said side panel by a scoreline perpendicular to the scorelines separating said side panel from said front panel.

7. The carton according to claim 4 wherein said front panel extends no more than 80% of the distance from the scoreline separating the top panel from the front panel to the scoreline separating the underlying flap or panel from the bottom panel.

8. The carton according to claim 7 wherein said front panel extends no more than 75% of the distance from the scoreline separating the top panel from the front panel to the scoreline separating the underlying flap or panel from the bottom panel.

9. The carton according to claim 7 further comprising an inside major flap separated from the bottom panel by a scoreline perpendicular to the scoreline separating the bottom panel from the side panel, and an outside major flap separated from said top panel by a scoreline perpendicular to the scorelines separating said front panel from said side panels.

10. The carton of claim 1 containing a stack of separate fabric softener sheets.

11. The carton of claim 10 wherein said stack of separate dryer sheets is folded along the transverse axis of said sheets to form a bight.

12. The carton according to claim 10 wherein at least 20% of the sheets are offset from the sheet directly above or the sheet directly below.

13. The carton according to claim 12 wherein the separate fabric softener sheets are offset in a transverse direction.

14. The carton according to claim 13 wherein said separate fabric softener sheets are each individually folded to form a dove tail.

15. The carton according to claim 10 wherein said separate fabric softener sheets are dryer softener sheets.

16. The carton according to claim 15 wherein at least 50% of said separate fabric softener sheets are offset with respect to the sheet, if any, immediately above and with respect to the sheet, if any, immediately below.

17. The carton according to claim 10 wherein said separate fabric softener sheets are not interleaved.

18. The carton according to claim 1 wherein the lines of weakness forming said access flap on said front panel comprise two lines of weakness extending diagonally medially from two points on the score line separating said front and top panels, then extend medially from said diagonally extending lines of weakness in a direction parallel to the scoreline separating the front and top panels, then extend perpendicularly to the scoreline separating the top and front panels, said access flap further comprising free edges extending diagonally medially from said perpendicular lines of weakness to a further free edge extending parallel to said score line separating said top and front panels.

19. The carton according to claim 18 wherein the lines of weakness extending inwardly from said diagonally extending lines of weakness in a direction parallel to the scoreline separating the front and top panels comprise cut lines, and said lines of weakness extending perpendicularly to the scoreline separating the top and front panels comprise cut lines.

20. The carton according to claim 1 wherein said front panel is adhered to said underlying panel with adhesive.

21. The carton according to claim 20 wherein the adhesive is hot melt.

22. A carton blank having a first panel for forming a top of a carton, said top-forming panel being separated by a scoreline from a panel for forming a front of a carton, said front-forming panel having a free edge, said top-forming and front-forming panels including lines of weakness in part defining an access flap extending from said free edge of said front-forming panel to a hinge comprising a scoreline on said top-forming panel, panels for forming sides of the carton on opposite sides of said top-forming panel and separated therefrom by parallel scorelines perpendicular to the scoreline separating said top-forming panel from said front-forming panel, and a bottom panel separated from one of said side panels by a scoreline parallel to the scorelines separating said side panels from said top panel, a flap or panel for underlying said front panel, said underlying flap or panel being separated from said bottom panel by a scoreline perpendicular to the scoreline separating said bottom panel from said side panel, said carton blank including a rear panel adjacent said top panel on a side opposite said front panel, said adjacent panel having two ends, a flap having two free side edges being disposed at each end of said adjacent panel, said underlying flap having two sides and not including a minor flap adjacent both of said sides.

23. The carton blank of claim 22 wherein said access flap includes a reclosure tab adjacent its free edge and said flap or panel for underlying the front panel includes an aperture dimensioned to receive the reclosure tab.

24. The carton blank of claim 23 wherein said side panels each have two ends and further comprising minor flaps at each of said side panel ends separated therefrom by scorelines perpendicular to the scorelines separating said side panels from said front panels.

25. The carton blank of claim 22 wherein said front panel includes two portions lateral to the access flap for adhering to the underlying flap or panel, on either side of said access flap.

26. The carton blank of claim 22 further comprising a glue flap separated from said bottom panel by a scoreline parallel to the scoreline separating said bottom panel from said side panel and on a side opposite said scoreline separating said bottom panel from said side panel.

27. The carton blank according to claim 22 wherein said score line defining the hinge has two ends, each said access flap-defining line of weakness in said top panel being connected to said hinge at one of said ends by a radial cut, each said access flap-defining line of weakness extending perpendicularly to said hinge, said lines of weakness extending perpendicularly to said panel-separating score line separating said front and top panels, said access flap-defining lines of weakness in said top panel not including straight lines of weakness extending obliquely to said access flap-defining lines of weakness.

28. The carton blank according to claim 22 wherein the lines of weakness forming said access flap on said front-forming panel comprise lines of weakness extending diagonally inwardly from the score line separating said front- and top-forming panels, then extend inwardly from said diagonally extending lines of weakness in a direction parallel to the scoreline separating the front and top panels, then extend perpendicularly to the scoreline separating the top and front panels, said access flap further comprising free edges extending diagonally inwardly from said perpendicular lines of weakness to a further free edge extending parallel to said score line separating said top and front panels.

29. The carton blank according to claim 28 wherein the lines of weakness extending inwardly from said diagonally extending lines of weakness in a direction parallel to the scoreline separating the front and top panels comprise cut lines, and said lines of weakness extending perpendicularly to the scoreline separating the top and front panels comprise cut lines.

* * * * *